US006647877B2

(12) United States Patent
Voge

(10) Patent No.: US 6,647,877 B2
(45) Date of Patent: Nov. 18, 2003

(54) INKING UNIT, PARTICULARLY FOR AN OFFSET PRINTING MACHINE, HAVING HARD/HARD SMOOTHING ROLLER CONFIGURATION

(75) Inventor: Michael Voge, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 103 days.

(21) Appl. No.: 09/927,572

(22) Filed: Aug. 9, 2001

(65) Prior Publication Data

US 2002/0020316 A1 Feb. 21, 2002

(30) Foreign Application Priority Data

Aug. 9, 2000 (DE) ..... 100 38 771

(51) Int. Cl.[7] ..... B41F 31/00
(52) U.S. Cl. ..... 101/349.1; 101/351.8
(58) Field of Search ..... 101/351.8, 349.1, 101/207, 206, 348, 366, 202, 205

(56) References Cited

U.S. PATENT DOCUMENTS 3,283,712 A 11/1966 Chambon
4,373,442 A * 2/1983 Dahlgren et al. ..... 101/207
4,787,313 A * 11/1988 Osborn et al. ..... 101/366
5,355,799 A 10/1994 Lutz
5,603,262 A * 2/1997 Uera et al. ..... 101/350.5

FOREIGN PATENT DOCUMENTS

| | | |
|---|---|---|
| DE | 1 173 912 | 7/1964 |
| DE | 6910823 | 3/1969 |
| DE | 42 39 793 A1 | 7/1993 |
| DE | 42 37 312 A1 | 2/1995 |
| DE | 44 05 912 A1 | 8/1995 |
| DE | 198 59 436 A1 | 6/2000 |

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Gregory L. Mayback

(57) ABSTRACT

An inking unit includes a first smoothing roller, an ink feed unit constructed as an ink droplet generator for applying a metered quantity of ink to the first smoothing roller, by one of an indirect and a direct path, respectively, the indirect path being via at least one additional roller interposing the ink feed unit and the first smoothing roller, and the direct path being directly to the first smoothing roller, and further including a second smoothing roller operatively connected to the first smoothing roller for distributing the application of ink, each of the first and the second smoothing rollers having a hard smoothing surface with a hardness of one of at least 80 Shore A and at least 30 Shore D, respectively, for forming a uniform film of ink; and an offset printing machine including the inking unit.

14 Claims, 4 Drawing Sheets

INKING UNIT, PARTICULARLY FOR AN OFFSET PRINTING MACHINE, HAVING HARD/HARD SMOOTHING ROLLER CONFIGURATION

BACKGROUND OF THE INVENTION

FIELD OF THE INVENTION

The invention relates to an inking unit, particularly for an offset printing machine, having a first smoothing roller, an ink feed unit formed as a droplet generator for applying a metered quantity of ink indirectly via an additional roller interposing the ink feed unit and the first smoothing roller, or directly, to the first smoothing roller, and a second smoothing roller operatively connected to the first smoothing roller for distributing the applied ink.

Inking units of the type mentioned at the introduction hereto have become known heretofore. It is disadvantageous that, with inking units of this type, a locally, relatively intensive accumulation of ink on a first smoothing roller is not completely evened out. In this regard, a locally limited and intensive accumulation of ink, which is also referred to as an "ink dot", is produced by an application of ink to a smoothing roller, for example, by a valve technique already known heretofore. The published German Patent Document DE 43 27 212 A1 describes a transfer of ink in the printing unit of an offset printing machine by a digitally controllable ink jet printing apparatus, and the published German Patent Document DE 44 05 912 A1 is concerned with a contact-free application of ink to rotating printing systems. By the valve technique, it is possible to transfer an offset ink in a pulse-like manner in the form of small drops or droplets to a smoothing roller of an inking unit of an offset printing machine utilizing digital control. In this regard, what is involved is a virtually point-like application of ink to a smoothing roller, the extent of the ink application being considerably smaller than the nominal size of an inking area to be implemented or realized by the inking unit. It is disadvantageous that such locally limited, point-like accumulations of ink are visible on a printed paper sheet. The cause of such a qualitative restriction on the offset printing result is the aforementioned inadequate evening-out of the locally limited accumulation of ink (ink dot) by conventional offset inking units.

SUMMARY OF THE INVENTION

It is accordingly an object of the invention to provide an inking unit, particularly of an offset printing machine, which, in a relatively simple and reliable manner, achieves an evening-out of a locally limited accumulation of ink on a smoothing roller, especially of an offset inking unit, which is sufficient to improve the printing quality.

With the foregoing and other objects in view, there is provided, in accordance with one aspect of the invention, an inking unit, comprising a first smoothing roller, an ink feed unit constructed as an ink droplet generator for applying a metered quantity of ink to the first smoothing roller, by one of an indirect and a direct path, respectively, the indirect path being via at least one additional roller interposing the ink feed unit and the first smoothing roller, and the direct path being directly to the first smoothing roller, and further comprising a second smoothing roller operatively connected to the first smoothing roller for distributing the application of ink, each of the first and the second smoothing rollers having a hard smoothing surface with a hardness of one of at least 80 Shore A and at least 30 Shore D, respectively, for forming a uniform film of ink.

In accordance with another feature of the invention, the respective smoothing surface is formed of a substance selected from the group thereof consisting of hard rubber, polyurethane and the composition known by the trade name Rilsan, respectively.

In accordance with a further feature of the invention, the ink feed unit is an inkjet device.

In accordance with an added feature of the invention, the second smoothing roller is operatively connected to a supporting roller.

In accordance with an additional feature of the invention, the smoothing surfaces have a hardness of 95 Shore A.

In accordance with yet another feature of the invention, the supporting roller has a supporting surface with a hardness of less than 60 Shore A.

In accordance with yet a further feature of the invention, the supporting roller has a supporting surface with a hardness of 25 Shore A.

In accordance with yet an added feature of the invention, at least one additional smoothing roller having a smoothing surface and disposed at a spaced distance from the second smoothing roller is in operative connection with the first smoothing roller.

In accordance with yet an additional feature of the invention, after the ink has been applied, the additional smoothing roller is disposed downline from the second smoothing roller, as viewed in the direction of rotation of the first smoothing roller.

In accordance with still another feature of the invention, the smoothing surface of the additional smoothing roller is a comparatively hard smoothing surface and has a hardness of one of at least 80 Shore A and at least 30 Shore D, respectively.

In accordance with still a further feature of the invention, the smoothing surface of the additional smoothing roller has a hardness of 95 Shore A.

In accordance with still an added feature of the invention, the smoothing surface of the additional smoothing roller is a comparatively soft smoothing surface and has a hardness of less than 60 Shore A.

In accordance with still an additional feature of the invention, the smoothing surface of the additional smoothing roller has a hardness of 25 Shore A.

In accordance with another aspect of the invention, there is provided an inking unit, comprising a first smoothing roller, an ink feed unit constructed as an ink droplet generator for applying a metered quantity of ink to the first smoothing roller, by one of an indirect and a direct path, respectively, the indirect path being via at least one additional roller interposing the ink feed unit and the first smoothing roller, and the direct path being directly to the first smoothing roller, and further comprising at least one additional smoothing roller operatively connected to the first smoothing roller for distributing the application of ink, the first smoothing roller having a hard smoothing surface with a hardness of one of at least 80 Shore A and at least 30 Shore D, respectively, and the at least one additional smoothing roller having a soft smoothing surface of less than 60 Shore A, for forming a uniform film of ink.

In accordance with a further aspect of the invention, there is provided an inking unit, comprising a first smoothing roller, an ink feed unit constructed as an ink droplet generator for applying a metered quantity of ink to the first smoothing roller, by one of an indirect and a direct path, respectively, the indirect path being via at least one additional roller interposing the ink feed unit and the first smoothing roller, and the direct path being directly to the first smoothing roller, and further comprising a second smoothing roller operatively connected to the first smoothing roller for distributing the application of ink, and a drive for rotationally driving the second smoothing roller at a circumferential speed differing from the circumferential speed of the first smoothing roller, for forming a uniform film of ink.

In accordance with an added aspect of the invention, there is provided an offset printing machine having an inking unit comprising a first smoothing roller, an ink feed unit constructed as an ink droplet generator for applying a metered quantity of ink to the first smoothing roller, by one of an indirect and a direct path, respectively, the indirect path being via at least one additional roller interposing the ink feed unit and the first smoothing roller, and the direct path being directly to the first smoothing roller, and further comprising a second smoothing roller operatively connected to the first smoothing roller for distributing the application of ink, each of the first and the second smoothing rollers having a hard smoothing surface with a hardness of one of at least 80 Shore A and at least 30 Shore D, respectively, for forming a uniform film of ink.

In accordance with an additional aspect of the invention, there is provided an offset printing machine having an inking unit, comprising a first smoothing roller, an ink feed unit constructed as an ink droplet generator for applying a metered quantity of ink to the first smoothing roller, by one of an indirect and a direct path, respectively, the indirect path being via at least one additional roller interposing the ink feed unit and the first smoothing roller, and the direct path being directly to the first smoothing roller, and further comprising at least one additional smoothing roller operatively connected to the first smoothing roller for distributing the application of ink, the first smoothing roller having a hard smoothing surface with a hardness of one of at least 80 Shore A and at least 30 Shore D, respectively, and the at least one additional smoothing roller having a soft smoothing surface of less than 60 Shore A, for forming a uniform film of ink.

In accordance with yet another aspect of the invention, there is provided an offset printing machine having an inking unit, comprising a first smoothing roller, an ink feed unit constructed as an ink droplet generator for applying a metered quantity of ink to the first smoothing roller, by one of an indirect and a direct path, respectively, the indirect path being via at least one additional roller interposing the ink feed unit and the first smoothing roller, and the direct path being directly to the first smoothing roller, and further comprising a second smoothing roller operatively connected to the first smoothing roller for distributing the application of ink, and a drive for rotationally driving the second smoothing roller at a circumferential speed differing from the circumferential speed of the first smoothing roller, for forming a uniform film of ink.

In accordance with a concomitant feature of the invention, the inking unit is of an offset printing machine.

The aforementioned object of the invention is thus achieved by providing an inking unit wherein, for forming a uniform film of ink, the first and second smoothing rollers each have a hard smoothing surface with a hardness which is at least 80 Shore A or at least 30 Shore D.

Heretoforeknown offset inking units have pairs of rollers with operative surface connections which are characterized by a hard/soft or soft/soft category. Because of the relatively high hydrodynamic pressure which is established in the respective nip, and also the low hardness of the soft surfaces (rubber with a low elastomer stiffness), a metered, locally limited application of ink (ink dot) is not sufficiently smoothed or evened out by such pairings of rollers.

By providing a roller pairing according to the invention having an operative surface connection of the hard/hard category, the evening out of locally limited, intensive accumulations of ink in an offset inking unit, which is sufficient to ensure a reproducible improvement in the printing quality, is achieved in a relatively simple and reliable manner. Therefore, by the roller pairing with the operative surface connection hard/hard, a sufficiently evened out film of ink is produced from an ink dot and can then be processed further by an inking unit of otherwise conventional construction. The achieved evening-out effect results primarily from the ink dot being rolled out in the circumferential direction of the rollers, with a considerable reduction in the height of the ink dot and, to a secondary extent, by the application of ink being distributed by rubbing on the surfaces of the rollers. The smoothing surfaces each have a hardness of at least 80 Shore A or at least 30 Shore D. By these hardness values, optimized results can be achieved with regard to evening out locally limited accumulations of ink.

The respective smoothing surface is advantageously formed of hard rubber or polyurethane or the aforementioned substance having the trade name Rilsan. These materials are particularly suitable for producing a hard smoothing surface.

The ink feed unit is preferably a droplet generator in the form of an inkjet device. An ink feed unit constructed in this way is particularly suitable for contact-free application of ink, forming an ink dot on a smoothing roller. This ink feed unit therefore uses valve technology.

According to another embodiment, the ink feed unit is operatively connected directly to the first smoothing roller. This permits the inking unit to have a compact configuration, at least in the region of ink application by the ink feed unit, because the application of ink takes place directly from the ink feed unit to the first smoothing roller.

According to an alternative embodiment, the ink feed unit is operatively connected indirectly to the first smoothing roller, with the interposition of a single additional roller or a plurality of additional rollers. For example, the single additional roller or one of the additional rollers, respectively, may be formed by the second smoothing roller which, in this case, finds a multifunctional use. By such an indirect application of ink, further optimization with regard to evening out the ink dot on the first smoothing roller can be achieved, if necessary or desirable.

The second smoothing roller is preferably operatively connected to a supporting roller. The supporting roller is used for preventing the second smoothing roller from bending due to the relatively high hydrodynamic pressure which is established between the two smoothing rollers. In this regard, the supporting roller can have a soft surface covering.

The smoothing surfaces advantageously have a hardness of 95 Shore A, and the supporting roller has a supporting surface with a hardness of less than 60 Shore A and, in particular, of about 25 Shore A. By these hardness values, unwanted bending of the second smoothing roller due to the relatively high hydrodynamic pressure that is established in the nip between the two smoothing rollers is avoided, and therefore optimized evening out of the application of ink on the first smoothing roller is achieved.

According to a further development, at least one additional smoothing roller with a hard smoothing surface is operatively connected to the first smoothing roller, at a spaced distance from the second smoothing roller. Such an arrangement is advantageous, in particular, in a shortened inking unit, because, in a shortened inking unit, a lower number of roller pairings is provided, so that through the intermediary of an additional smoothing roller, operatively connected to and parallel to the first smoothing roller, correct evening out of the application of ink can be achieved in a reliable and flexible manner, even in a shorter inking unit.

The additional smoothing roller is advantageously arranged downline of the second smoothing roller, as viewed in the direction of rotation of the first smoothing roller, after the ink has been applied. In this way, through the intermediary of the additional smoothing roller, the result already achieved by the operative connection between the first and the second smoothing roller can be optimized with regard to adequate evening out of the application of ink.

According to a further development, to form a uniform film of ink, the second smoothing roller is driven rotationally by a drive with a circumferential surface speed that differs from that of the first smoothing roller. By producing a differential speed of this type between the first and the second smoothing roller, slippage is produced in the contact area therebetween. With the aid of sufficiently high slippage, the local accumulation of ink is rolled out and, in particular, an "ink peak" which may be present is removed. In this way, with the aid of axial frictional distribution and in cooperation with further inking rollers in an inking unit (roll stand), uniform application of ink is advantageously obtained. In this regard, the realization of a desired differential speed between the first and the second smoothing rollers is performed by a suitable drive, for example, in the form of an appropriately constructed gear drive, or a direct drive via a separate drive motor.

Other features which are considered as characteristic for the invention are set forth in the appended claims.

Although the invention is illustrated and described herein as embodied in an inking unit, especially for an offset printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
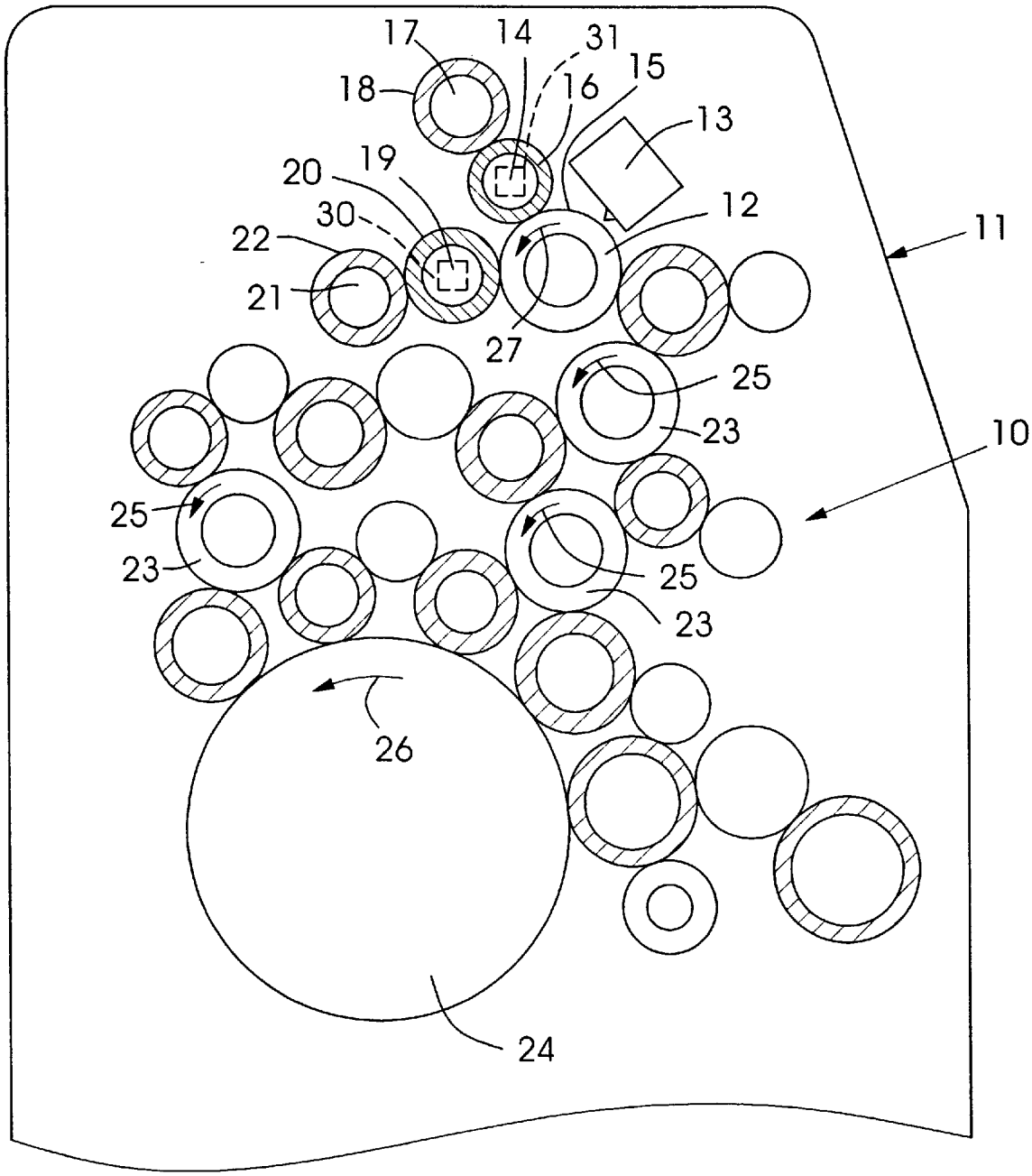
FIG. 1 is a diagrammatic side elevational view, partly in section, of a first embodiment of an inking unit according to the invention for an offset printing machine.

Referring now to the drawings and, first, particularly to FIG. 1 thereof, there is shown therein a diagrammatic illustration of a first embodiment of an inking unit, generally identified by reference numeral 10, for an offset printing machine 11. The inking unit 10 has a first smoothing roller 12, which is formed as a distributor roller and is of itself heretofore known. An ink feed unit 13 serves for applying the metered quantity of ink to the first smoothing roller 12, forming a locally limited, intensive accumulation of ink, which is also referred to as an "ink dot". An ink dot is therefore a locally relatively large accumulation of ink, which is to be evened out by the inking unit 10. The ink feed unit 13 is preferably formed as a droplet generator and, in particular, as an inkjet device, using valve technology, which is likewise of itself known. In the direction of rotation represented by the arrow 27 of the first smoothing roller 12, directly downline of the ink feed unit 13, a second smoothing roller 14 for distributing the ink applied to the first smoothing roller 12 is operatively connected to the latter. A supporting roller 17 is in operative contact with the second smoothing roller 14 and serves for avoiding undesired bending of the second smoothing roller 14 due to the relatively high hydrodynamic pressure that is established in the nip between the two smoothing rollers 12 and 14, respectively. An additional smoothing roller 19 is arranged immediately downline of the second smoothing roller 14, as viewed in the direction of rotation of the first smoothing roller 12, namely according to the arrow 27, and is disposed at a distance from the second smoothing roller 14 and operatively connected to the first smoothing roller 12 for the further distribution of the ink applied to the latter. The additional smoothing roller 19 is also secured against bending by a supporting roller 21. The first, second and additional smoothing rollers 12, 14 and 19, respectively, are provided with hard smoothing surfaces 15, 16 and 20, respectively, for forming a uniform film of ink on the first smoothing roller 12. In contrast, the supporting rollers 17 and 21, respectively, have preferably soft supporting surfaces 18 and 22, respectively. Preferred hardness values of the smoothing surfaces 15, 16 and 20 are at least 80 Shore A or at least 30 Shore D and, in particular, 95 Shore A, while the supporting surfaces 18 and 22, respectively, of the supporting rollers 17 and 21, respectively, are formed of a soft rubber or elastomer, preferably having a respective hardness of 25 Shore A. The smoothing surfaces 15, 16 and 20 of the smoothing rollers 12, 14 and 19, respectively, can be formed of hard rubber or polyurethane or the composition known by the trade name Rilsan, for example. The inking unit 10 according to FIG. 1 has three further distributor rollers 23, which rotate in accordance with the arrows 25 and are operatively connected, indirectly via inking-unit and ink-applicator rollers, to a printing form cylinder 24, which rotates in accordance with the arrow 26. The further construction and functioning of the inking unit 10 according to FIG. 1 are in itself known and will therefore not be described in any greater detail herein.

The second and the additional smoothing rollers 14 and 19 are pressed against the first smoothing roller 12 with controlled force by a likewise known rolling-contact bearing system, forming a respectively hard roller pairing and a static nip width of about 2 mm. The supporting rollers 17 and 21, respectively, are also pressed against the second smoothing roll 14 and against the additional smoothing roller 19, respectively, in a conventional manner with controlled force through the intermediary of a rolling-contact bearing system, forming a roller pairing of the soft/hard category and a static nip width of, for example, 4 to 5 mm. If necessary or desirable, the arrangement of the additional smoothing roller 19 and/or the supporting roller 21 can be dispensed with. The inking unit 10 illustrated in FIG. 1 is a so-called long inking unit, having four distributor rollers 12, 23.

Figure 2:
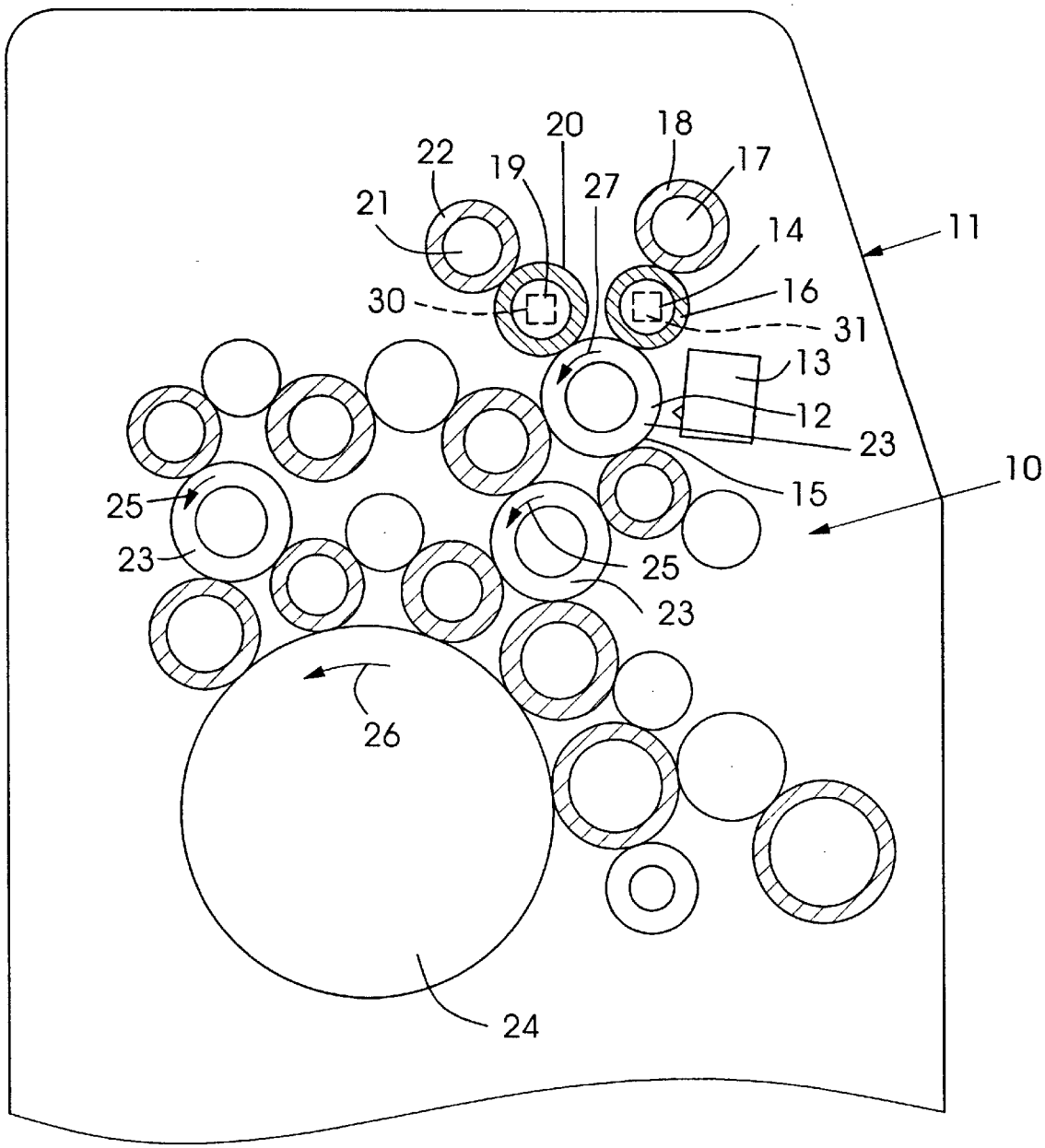
FIG. 2 is a view similar to that of FIG. 1 of a second embodiment of the inking unit.

FIG. 2 is a diagrammatic illustration of a so-called short inking unit 10, which has three distributor rollers 23 and, with regard to the construction and the functioning thereof, corresponds in essence to the inking unit 10 of FIG. 1, for which reason the reference numerals from FIG. 1 have been adopted in FIG. 2 for functionally identical parts. Opposed to the embodiment according to FIG. 1, in FIG. 2 the upper distributor roller 23 serves as a first smoothing roller 12, on the smoothing surface 15 of which a metered application of ink is performed by the ink feed unit 13. Compared with the inking unit 10 of FIG. 1, the inking unit 10 of FIG. 2 is therefore of more compact construction. In the embodiment of the inking unit 10 of FIG. 2, it is likewise also possible to dispense with the additional smoothing roller 19 and the additional supporting roller 21, if necessary or desirable.

Additionally or alternatively to the aforementioned embodiments according to FIG. 1 and FIG. 2, there is the possibility for generating a uniform film of ink for rotationally driving the second smoothing roller 14 and, if necessary or desirable, also the additional smoothing roller 19, by a respective associated drive 31, 30, at a circumferential surface speed which differs from that of the first smoothing roller 12. In this embodiment, a differential speed is produced between the smoothing rollers 14 and 19, on the one hand, and the smoothing roller 12, on the other hand. The smoothing rollers 14 and 19, respectively, rotate with a different circumferential speed than that of the smoothing roller 12 (a distributor roller). Therefore, with reference to the smoothing roller 12, differential speeds occur which lead to slippage in the contact area. With the aid of sufficiently high slippage, a local accumulation of ink which is to be evened out is rolled out and, in particular, an "ink peak" that is present is removed. Therefore, via axial frictional distribution and in cooperation with further inking rollers in the inking unit (roll stand), a uniform application of ink is achieved. In order to implement a desired differential speed of this type, the drive 31 or 30 can be constructed, for example, as a suitably engineered gear drive or as a direct drive with separate drive motors.

According to the illustrated embodiments of FIGS. 1 and 2, the ink feed unit 13 is operatively connected directly to the first smoothing roller 12. A locally limited application of ink is therefore made directly to the smoothing surface 15 of the first smoothing roller 12 by the ink feed unit 13, in particular, by valve technology. According to non-illustrated modifications of the embodiments shown in FIGS. 1 and 2, it is also possible to arrange an additional roller between the ink feed unit 13 and the first smoothing roller 12, so that an indirect application of ink on the first smoothing roller 12 is carried out, forming an ink dot.

The inking unit 10 according to the invention is advantageously suitable for obtaining reliable and sufficient evening out of an ink dot on the first smoothing roller 12 in a relatively simple manner.

Figure 3:
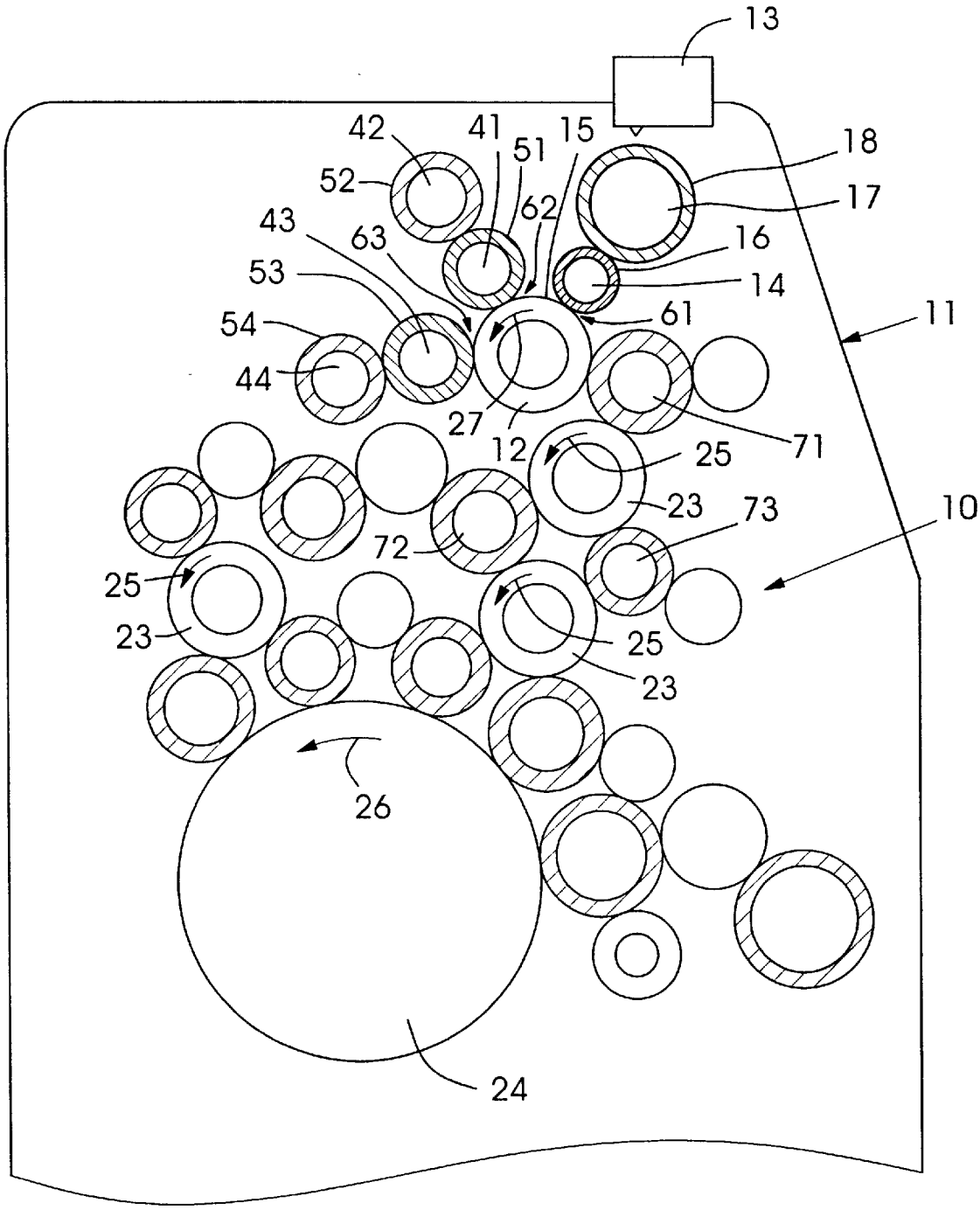
FIG. 3 is a view similar to those of FIGS. 1 and 2 of a third embodiment of the invention.
Figure 4:
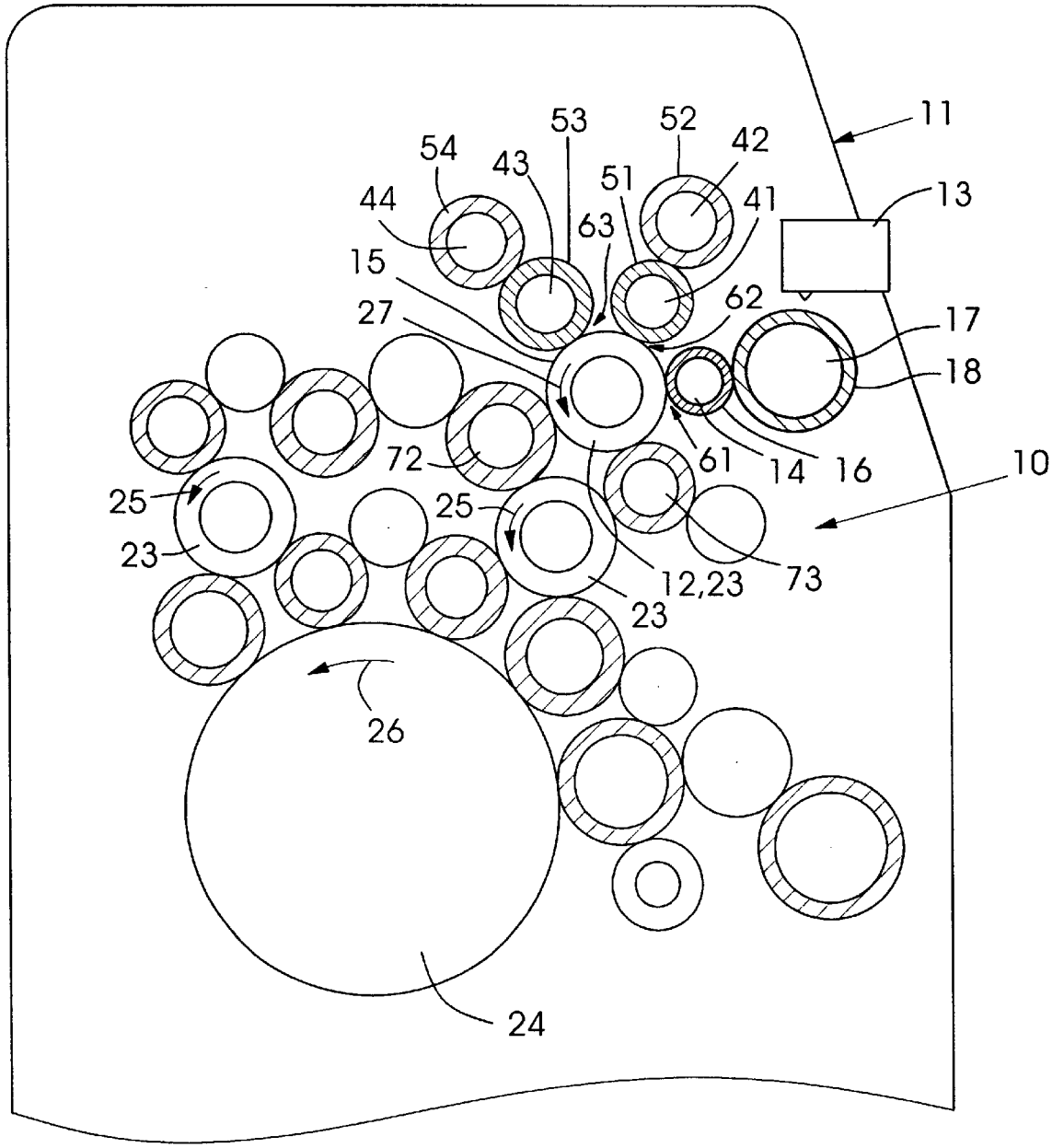
FIG. 4 is a view similar to those of FIGS. 1, 2 and 3 of a fourth embodiment of the inking unit according to the invention.

The third embodiment, shown in FIG. 3, constitutes a modification of the first embodiment described hereinbefore (note FIG. 1), and the fourth embodiment, shown in FIG. 4, emerges from the second embodiment, likewise just described (note FIG. 2). Therefore, the reference symbols for functionally identical parts from FIGS. 1 and 2 can also be adopted in FIGS. 3 and 4, and a repeated description of these parts hereinbelow is believed to be unnecessary.

The intrinsic feature in the embodiments shown in FIGS. 3 and 4 is that the second smoothing roller 14 has additional smoothing rollers 41 and 43 arranged downline therefrom, as viewed in the direction of rotation of the first smoothing roller 12. The number of additional smoothing rollers 41 and 43 in rolling contact with the first smoothing roller 12 may be from one to five. Advantageously, the outer diameter of each of the additional smoothing rollers 41 and 43, together with the outer diameter of the first smoothing roller 12, should form a ratio which has as many decimal points as possible and is approximated as closely as possible to an irrational number, so that it requires as many revolutions of a roller as possible until a specific circumferential point on the additional smoothing rollers 41 and 43, respectively, again comes to lie exactly opposite a specific circumferential point on the first smoothing roller 12. Each of the additional smoothing rollers 41 and 43, respectively, is equipped on the circumference thereof with a soft smoothing surface 51 and 53, respectively, formed of rubber or an elastomer having a hardness lower than the hardness of the smoothing surfaces 15 and 16, respectively, of the first smoothing roller 12 and of the second smoothing roller 14, respectively.

Placed on each additional smoothing roller 41, 43 which is present is a respective supporting roller 42, 44, which is in rolling contact only with the respective smoothing roller 41, 43 and which is provided with a respective supporting surface 52, 54 likewise formed of rubber or an elastomer.

The hardness of the respective smoothing surface 51, 53 of each additional smoothing roller 41 and 43 and of the supporting surface 53, 54 of each supporting roller 42 and 44, respectively, is less than 60 Shore A and preferably about 25 Shore A.

In the event of so-called cambering or bulging, i.e., a spherical deformation of the smoothing rollers 41 and 43, respectively, the supporting rollers 42 and 44, respectively, may possibly be dispensed with. By the provision of the cambering and/or the supporting rollers 42 and 44, respectively, an effort is made to counteract axial bending of the smoothing rollers 41 and 43, respectively.

A special feature of the embodiments shown in FIGS. 3 and 4 is that the ink feed unit 13 is directed towards the supporting roller 17, so that the ink droplets expelled by the ink feed unit 13 strike the circumferential surface (supporting surface 18) of the supporting roller 17. The supporting roller 17 and the second smoothing roller 14 are thus disposed between the ink feed unit 13 and the first smoothing roller 12 for the purpose of applying ink indirectly onto the latter.

Deviating therefrom, it is also conceivable, in a modification of the embodiments shown in FIGS. 3 and 4, to direct the ink feed unit 13 towards the second smoothing roller 14 and not towards the supporting roller 17 or, in a manner comparable with the preceding embodiments (note FIGS. 1 and 2), to direct the ink feed unit 13 towards the first smoothing roller 12, specifically towards a circumferential point located upline from the second smoothing roller 14, in the direction of rotation of the first smoothing roller 12.

Both in the case of the embodiments shown in FIGS. 3 and 4 and in the case of the modifications which were aforedescribed but not illustrated, the selected directions of rotation of the rollers ensure that the ink droplets applied to the respective rollers 12, 14 and 17 by the ink feed unit 13 are conveyed initially through the virtually unyielding nip 61, which is formed by pressing the two comparatively hard smoothing surfaces 15 and 16 against one another, and only then through at least one resiliently yielding nip 62, 63, which is formed by including a comparatively soft smoothing surface 53.

The unyielding nip 61 effects a very powerful and quick evening out of the ink dots 10 formed by the ink droplets on the roller surfaces so as to form a film of ink, so that the total number of nip points (nips) necessary for effecting the evening out of the ink dots in the inking unit 10 can be kept low. The yielding nips 62, 63 which are present and the number of which can be from one to five and, for example, two as shown, have the effect of a very high degree of evening out of the liquid surface of the film of ink generated from the ink dot. In studies, it has transpired that the ink dots can be rolled flat particularly effectively to form a film of ink suitable for application to the printing form cylinder 24 under the action of an unyielding nip 61 and the immediately following action of a yielding nip 62, 63.

In the embodiments shown in FIGS. 3 and 4, the supporting roller 17 can be constructed as a roller which oscillates in the axial direction (distributor roller), and in order to achieve a particularly high Hertzian pressure in the nip 61, the outer diameter of the second smoothing roller 14 is dimensioned to be particularly small.

In the case of a short inking unit, which likewise belongs within the scope of the invention but is not illustrated and which likewise includes the parts identified by the reference numerals 12 to 18, 23 and 24 in FIG. 2 in the arrangement relative to one another corresponding to that of FIG. 2, the first smoothing roller 12 is in rolling contact with an ink applicator roller, which is the single ink applicator roller in this short inking unit and has a diameter which is the same size as that of the printing form cylinder 24 of the short inking unit. In addition, the short inking unit includes the rollers identified by the reference numerals 41 to 44 in FIG. 4, and therefore also the hard nip 61 and the soft nips 62, 63 following the latter.

I claim:

1. An inking unit, comprising a first smoothing roller, an ink feed unit constructed as an ink droplet generator for applying a metered quantity of ink to said first smoothing roller, by one of an indirect and a direct path, respectively, said indirect path being via at least one additional roller interposing said ink feed unit and said first smoothing roller, and said direct path being directly to said first smoothing roller, and further comprising a second smoothing roller operatively connected to said first smoothing roller for distributing the application of ink, each of said first and said second smoothing rollers having a hard smoothing surface with a hardness of one of at least 80 Shore A and at least 30 Shore D, respectively, for forming a uniform film of ink.

2. The inking unit according to claim 1, wherein the respective smoothing surface is formed of a substance selected from the group thereof consisting of hard rubber, polyurethane and the composition known by the trade name Rilsan, respectively.

3. The inking unit according to claim 1, wherein said ink feed unit is an inkjet device.

4. The inking unit according to claim 1, wherein said second smoothing roller is operatively connected to a supporting roller.

5. The inking unit according to claim 4, wherein said supporting roller has a supporting surface with a hardness of less than 60 Shore A.

6. The inking unit according to claim 4, wherein said supporting roller has a supporting surface with a hardness of 25 Shore A.

7. The inking unit according to claim 1, wherein said smoothing surfaces have a hardness of 95 Shore A.

8. The inking unit according to claim 1, wherein at least one additional smoothing roller having a smoothing surface and disposed at a spaced distance from said second smoothing roller is in operative connection with said first smoothing roller.

9. The inking unit according to claim 8, wherein, after the ink has been applied, said additional smoothing roller is disposed downline from said second smoothing roller, as viewed in the direction of rotation of said first smoothing roller.

10. The inking unit according to claim 8, wherein said smoothing surface of said additional smoothing roller is a comparatively hard smoothing surface and has a hardness of one of at least 80 Shore A and at least 30 Shore D, respectively.

11. The inking unit according to claim 10, wherein said smoothing surface of said additional smoothing roller has a hardness of 95 Shore A.

12. The inking unit according to claim 8, wherein said smoothing surface of said additional smoothing roller is a comparatively soft smoothing surface and has a hardness of less than 60 Shore A.

13. The inking unit according to claim 8, wherein said smoothing surface of said additional smoothing roller has a hardness of 25 Shore A.

14. An offset printing machine having an inking unit comprising a first smoothing roller, an ink feed unit constructed as an ink droplet generator for applying a metered quantity of ink to said first smoothing roller, by one of an indirect and a direct path, respectively, said indirect path being via at least one additional roller interposing said ink feed unit and said first smoothing roller, and said direct path being directly to said first smoothing roller, and further comprising a second smoothing roller operatively connected to said first smoothing roller for distributing the application of ink, each of said first and said second smoothing rollers having a hard smoothing surface with a hardness of one of at least 80 Shore A and at least 30 Shore D, respectively, for forming a uniform film of ink.

* * * * *